US011235230B2

(12) United States Patent
Tzomik et al.

(10) Patent No.: US 11,235,230 B2
(45) Date of Patent: Feb. 1, 2022

(54) SCRATCH-OFF STRUCTURES

(71) Applicant: HP Indigo B.V., Amstelveen (NL)

(72) Inventors: Inna Tzomik, Nes Ziona (IL); Hannoch Ron, Nes Ziona (IL); Sergio Brandriss, Nes Ziona (IL); Gleb Romantcov, Nes Ziona (IL); Faina Kogan, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 242 days.

(21) Appl. No.: 16/070,490

(22) PCT Filed: Apr. 20, 2016

(86) PCT No.: PCT/EP2016/058700

§ 371 (c)(1),
(2) Date: Jul. 16, 2018

(87) PCT Pub. No.: WO2017/182064

PCT Pub. Date: Oct. 26, 2017

(65) Prior Publication Data

US 2019/0030420 A1 Jan. 31, 2019

(51) Int. Cl.

| | |
|---|---|
| ***B41M 3/00*** | (2006.01) |
| ***B42D 15/02*** | (2006.01) |
| ***B42D 25/20*** | (2014.01) |
| ***B42D 25/27*** | (2014.01) |
| ***A63F 3/06*** | (2006.01) |

(52) U.S. Cl.

CPC ..... *A63F 3/0665* (2013.01); *B41M 3/005* (2013.01); *B42D 15/025* (2013.01); *B42D 25/20* (2014.10); *B42D 25/27* (2014.10)

(58) Field of Classification Search
None
See application file for complete search history.

(56) References Cited

U.S. PATENT DOCUMENTS

| | | | |
|---|---|---|---|
| 8,523,078 | B2 | 9/2013 | Biskupski |
| 8,833,553 | B2 | 9/2014 | Corey et al. |
| 2002/0028321 | A1 | 3/2002 | Feilen et al. |
| 2007/0224398 | A1 | 9/2007 | Raksha et al. |
| 2010/0045026 | A1 | 2/2010 | Napolitano et al. |
| 2010/0253063 | A1 | 10/2010 | Skogster |

(Continued)

FOREIGN PATENT DOCUMENTS

| | | |
|---|---|---|
| CA | 2709564 | 1/2012 |
| CN | 1209095 | 2/1999 |

(Continued)

OTHER PUBLICATIONS

International Search Report dated Jan. 26, 2017 for PCT/EP2016/058700, Applicant Hewlett-Packard Indigo B.V.

*Primary Examiner* — Laura C Powers
(74) *Attorney, Agent, or Firm* — Thorpe North & Western LLP

(57) ABSTRACT

Herein is described a scratch-off structure comprising the following layers in order: a substrate having a first layer showing information thereon, a second layer comprising a polymeric film and being substantially transparent; a third layer comprising a transparent electrostatic ink; a fourth layer, wherein the fourth layer is coloured. Methods for making scratch-off structures and collections of scratch-off structures are also described.

17 Claims, 2 Drawing Sheets

(56) References Cited

U.S. PATENT DOCUMENTS

| | | | | |
|---|---|---|---|---|
| 2012/0025516 | A1 | 2/2012 | Miller et al. | |
| 2013/0106091 | A1* | 5/2013 | Kirchmeyer | B42D 15/00 283/85 |
| 2015/0323879 | A1* | 11/2015 | Kabalnov | C09D 11/037 428/207 |
| 2018/0229474 | A1* | 8/2018 | Tzomik | B32B 23/04 |

FOREIGN PATENT DOCUMENTS

| | | |
|---|---|---|
| CN | 104369565 | 2/2015 |
| WO | 2010130041 | 11/2010 |
| WO | 2015110173 | 7/2015 |
| WO | 2017067606 | 4/2017 |
| WO | 2017148515 | 9/2017 |

* cited by examiner

SCRATCH-OFF STRUCTURES

Scratch-off structures can be objects that have a layer comprising information and an overlying layer obscuring the information, which can be scratched off to reveal the information, but is typically resistant to normal abrasion. The information can vary in a collection of scratch-off structures, and they can be used for many purposes, such as gaming (e.g. in scratch cards used in lottery gaming) or authentication purposes (e.g. on a bank card).

DETAILED DESCRIPTION

Figure 1:
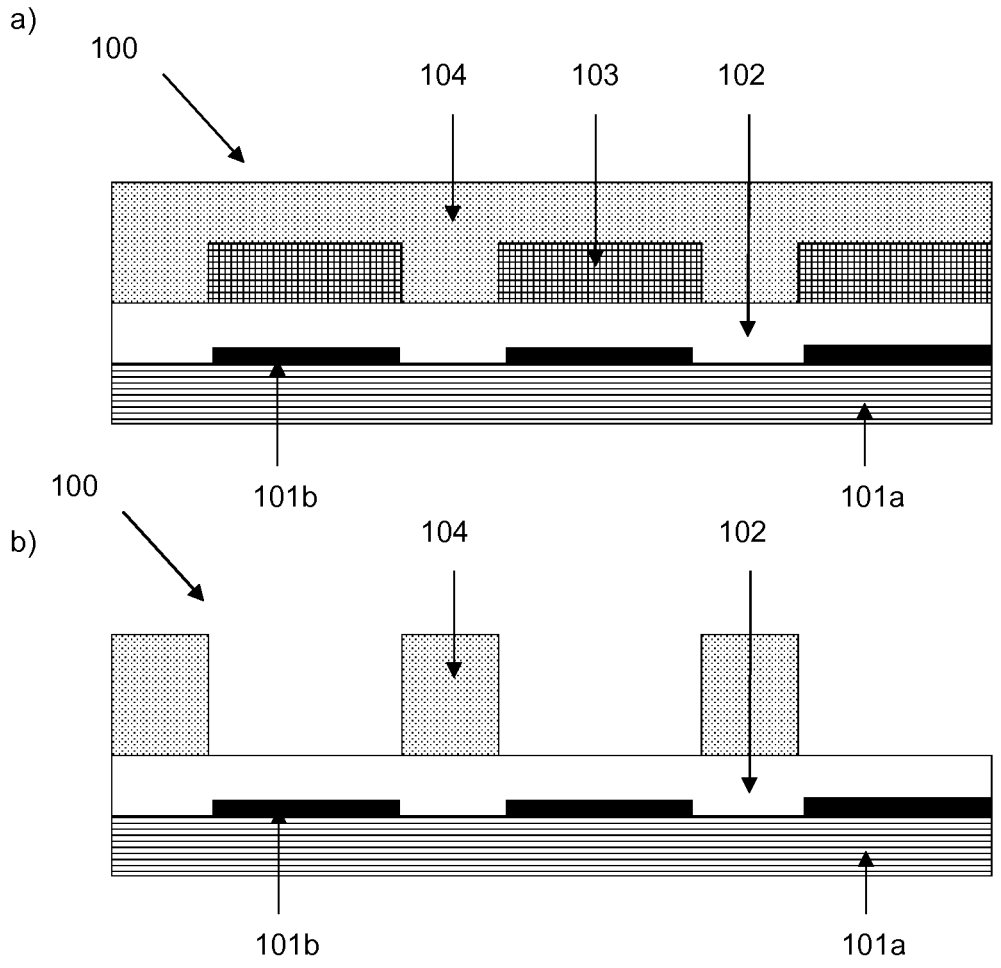
FIG. 1 schematically depicts a cross-section of an example of a scratch-off structure before (a) and after (b) the layers have been scratched.

Before the present disclosure is disclosed and described, it is to be understood that this disclosure is not limited to the particular process steps and materials disclosed herein because such process steps and materials may vary somewhat. It is also to be understood that the terminology used herein is used for the purpose of describing particular embodiments. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "carrier fluid", "carrier liquid," "carrier," or "carrier vehicle" refers to the fluid in which pigment particles, thermoplastic resin, charge directors and other additives can be dispersed to form a liquid electrostatic composition or electrophotographic composition. The carrier liquids may include a mixture of a variety of different agents, such as surfactants, co-solvents, viscosity modifiers, and/or other possible ingredients.

As used herein, "electrostatic ink composition" or "liquid electrophotographic composition" generally refers to an ink composition that is typically suitable for use in an electrostatic printing process, sometimes termed an electrophotographic printing process. It may comprise particles comprising a thermoplastic resin thereon. The transparent and/or coloured electrostatic ink composition may be a liquid electrostatic ink composition, in which the particles comprising a resin are suspended in a carrier liquid. The transparent and/or coloured electrostatic ink composition may be in a dry toner form, in which the toner particles are in a dry, but flowable form. In a coloured electrostatic ink composition, the particles may further include a colourant. In the transparent electrostatic ink composition, the particles may lack or substantially lack a colourant, but may further comprise a solid polar compound as described herein. The particles comprising resin will typically be charged or capable of developing charge in an electric field, such that they display electrophoretic behaviour. A charge director may be present to impart a charge to the pigment particles having resin thereon.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer, as known in the art. If a melt flow rate of a particular polymer is specified, unless otherwise stated, it is the melt flow rate for that polymer alone, in the absence of any of the other components of the electrostatic composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrostatic composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid composition is employed in the electrophotographic process rather than a powder toner. An electrostatic printing process may involve subjecting the electrostatic composition to an electric field, e.g., an electric field having a field gradient of 50-400V/μm, or more, in some examples 600-900V/μm, or more.

As used herein, "NVS" is an abbreviation of the term "non-volatile solids".

As used herein, the term "about" is used to provide flexibility to a numerical range endpoint by providing that a given value may be a little above or a little below the endpoint to allow for variation in test methods or apparatus. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, and unless stated otherwise, wt % values are to be taken as referring to a weight-for-weight (w/w) percentage of solids in the ink composition, and not including the weight of any carrier fluid present.

Unless otherwise stated, any feature described herein can be combined with any aspect or any other feature described herein.

Herein is disclosed a method for producing a scratch-off structure. The method may comprise:

providing a substrate having a first layer showing information thereon, and a second layer overlying the first layer, the second layer comprising a polymeric film and being substantially transparent;

electrostatically printing a third layer over the second layer, the third layer comprising a transparent electrostatic ink;

disposing a fourth layer on the third layer, the fourth layer being coloured.

Herein is disclosed a scratch-off structure. The scratch-off structure may comprise the following layers in order:

a substrate having a first layer showing information thereon, a second layer comprising a polymeric film and being substantially transparent;

a third layer comprising a transparent electrostatic ink;

a fourth layer, wherein the fourth layer is coloured.

Also disclosed herein is a collection of scratch-off structures. In some examples, at least some of the scratch-off structures comprise the following layers in order:

a substrate having a first layer showing information thereon, a second layer comprising a polymeric film and being substantially transparent;

a third layer comprising a transparent electrostatic ink;

a fourth layer, wherein the fourth layer is coloured, and wherein the information of the first layer of at least two of the scratch-off structures is different to one another.

The present disclosure relates to a new method to produce scratch-off structures and new scratch-off structures. Examples of the method allow scratch-cards to be produced very efficiently. Some examples allow the variable information, the transparent electrostatic ink and the overlying coloured layer to all be printed using electrostatic printing, making production of the scratch cards very fast and efficient. The method also allows selective placement of the portions of the scratch-off structure that can be removed by scratching off the coloured layer. The adhesion between transparent electrostatic ink and a polymeric film has been found to be sufficiently weak that it allows removal of the transparent electrostatic ink by scratching, yet is sufficiently strong that gentle abrasion (e.g. in stacking or handling the structures) will not remove the transparent electrostatic ink.

Substrate Having a First Layer Showing Information Thereon

The substrate having a first layer may be or comprise any suitable material for supporting the second to fourth layers. The first layer may, for example, be or comprise any suitable material capable of having information displayed, e.g. printed, thereon. The first layer may comprise a material selected from an organic or inorganic material. The first layer may comprise a natural polymeric material, e.g. cellulose. The first layer may comprise a synthetic polymeric material, e.g. a plastic. The first layer may comprise a polymer formed from alkylene monomers, including, but not limited to, polyethylene and polypropylene, and copolymers such as styrene-polybutadiene. The polypropylene may be biaxially orientated polypropylene. The material may comprise a metal, which may be in sheet form. The metal may be selected from or made from, for instance, aluminum (Al), silver (Ag), tin (Sn), copper (Cu), mixtures thereof. In some examples, the substrate comprises a cellulosic paper, card or cardboard. In some examples, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate may be a cellulosic print substrate such as paper. The cellulosic substrate may be a coated cellulosic print substrate, e.g. having a coating of a polymeric material thereon.

The information on the first layer may comprise any indicia, for example indicia selected from pictures, words, symbols, characters, letters, numbers. The pictures, words, symbols, characters, letters, numbers may be from any language, alphabet or numbering system. In a collection of scratch-off structures, the information underlying the third and fourth layers may vary, i.e. such that different scratch-off structures display different information that can be revealed when the fourth layer is scratched off. The first layer may also comprise other information, in locations other than under the third and fourth layers, and this information may be the same in the collection of scratch-off structures.

The information may be printed on the first layer, and may be printed by any suitable print method, including, but not limited to electrostatic printing, ink-jet printing and offset lithography. The information may be printed and comprise a colourant selected from cyan, magenta, yellow, black and white. The information on the first layer may be printed using the electrostatic printing of a coloured electrostatic ink, which may be as described herein for the fourth layer.

Second Layer

A second layer may overlie the first layer. The second layer may comprise a polymeric film and/or be substantially transparent. "Substantially transparent" in the present context indicates that the information on the first layer is visible through the second layer. "Visible through the second layer" may indicate that it can be seen by a human from 30 cm, the human having a visual acuity of 1.0, as measured in accordance with ISO 8596.

The second layer typically acts as a protective layer over the information on first layer, such that on scratching the third and fourth layers off, the second layer remains in place. The second layer may have a higher abrasion resistance, for example as tested using a suitable test, such as ASTM D5181-09 than the third and/or fourth layer.

The polymeric film of the second layer may, for example, have been formed from or be an overprint varnish or primer. Such overprint varnishes are typically applied as protective layers over printed surfaces. An overprint varnish may be applied in liquid form, then cured and/or hardened, with solvent evaporation as appropriate to leave the solid overprint varnish. The overprint varnish may be selected from UV-curable varnish, an aqueous-based varnish, and a solvent-based varnish. The solvent-based varnish may comprise a vinyl acetate-based resin, an acrylic-based resin, a polyvinyl butyral (PVB)-based resin or a wax-based resin, such as oil-based alkyd resins. The water-based varnish may comprise a resin based on a styrenic binding system and/or an acrylic binding system. In some examples, the water-based varnish comprises a vinyl acrylic resin, such as a polyacrylic acid copolymer, such as an ethylene acrylic acid copolymer. The UV-curable varnish may contain polymers and/or monomers that cure, e.g. further polymerise and/or cross-link, when exposed to UV radiation.

The second layer may comprise a polymeric film adhered to the first layer.

In some examples, the polymeric film may be or comprises a sheet of plastic. The sheet of plastic may be a continuous sheet. The sheet of plastic may be a non-porous sheet of plastic.

The polymeric film may be or comprise a monoaxially stretched or biaxially stretched plastic. In some examples, the polymeric film may comprise a single layer of material, which may comprise or be plastic, or a plurality of layers of material, each of which may comprise or be plastic, and may be different to one another.

In some examples, the polymeric film is in the form of a sheet, in some examples a sheet of plastic, having a thickness of at least 5 μm, in some examples at least 10 μm, in some examples at least 30 μm, in some examples at least 40 μm. In some examples, the polymeric film is in the form of a sheet having a thickness of from 5 μm to 1 mm, in some examples 5 μm to 200 μm, in some examples 5 μm to 100 μm, in some examples 10 μm to 80 μm, in some examples 10 μm to 60 μm, in some examples 10 μm to 30 μm, in some examples 20 μm to 60 μm, in some examples 30 μm to 50 μm.

In some examples, the polymeric film comprises a plastic selected from a polyalkylene, polyethylene terephthalate, polyethylene terephthalate glycol, polystyrene, polyvinyl chloride, polyethylene-2,6-napthalate, polyhexamethylene adipamide, polymers of alpha mono-olefinically unsaturated hydrocarbons having polymer producing unsaturation such as butene, vinyl acetate, methylacrylate, 2-ethyl hexyl acrylate, isoprene, butadiene acrylamide, ethylacrylate and N-methyl-n-vinyl acetamide. In some examples, the polymeric film comprises a plastic selected from polyethylene, polypropylene, polyisopropylethylene and polyisobutylethylene.

In some examples, the polymeric film comprises a monoaxially or biaxially oriented sheet of plastic. In some examples, the polymeric film comprises a plastic selected from an oriented polypropylene and an oriented polyethylene. In some examples, the plastic of the polymeric film is selected from monoaxially oriented polypropylene, biaxially oriented polypropylene, monoaxially oriented polyethylene and biaxially oriented polyethylene.

The polymeric film may be adhered to the first layer by an adhesive or by direct fusing of the materials of the first and second layers. In an example, the adhesive is an thermally fusible adhesive. In an example, the adhesive is a hot-melt adhesive. In an example, the adhesive is a pressure-sensitive adhesive. The adhesive may be selected from ethylene vinyl acetate (EVA), polyethylene, polystyrene, polypropylene, polybutene, polyester, poly(meth)acrylate, polyamides, thermoplastic polyimides, polyesters, polyurethanes, styrene block co-polymers (such as styrene-butadiene-styrene, styrene-isoprene-styrene, styrene-ethylene/butylene-styrene and styrene-ethylene/propylene).

Third Layer

The third layer may comprise an electrostatic ink. In some examples, the electrostatic ink is a transparent electrostatic ink. "Transparent" in the present context indicates that the information on the first layer is visible through the second layer and the third layer. "Visible through the second layer and the third layer" may indicate that it can be seen by a human from 30 cm, the human having a visual acuity of 1.0, as measured in accordance with ISO 8596.

Transparent Electrostatic Ink

The transparent electrostatic ink, which may also be termed a transparent electrostatic ink composition, may comprise a thermoplastic resin. It may further comprise a charge adjuvant and/or a charge director. The transparent electrostatic ink composition does not contain any pigment, or comprises substantially lacks pigment and thus is a pigment-free composition. The transparent electrostatic ink composition may otherwise be termed a colourless electrostatic ink composition or a colorless varnish for digital printing. The transparent electrostatic ink composition may comprise less than 5 wt % solids of colorant, in some examples less than 3 wt % solids of colorant, in some examples less than 1 wt % solids of colorant. "Colorant" may be a material that imparts a color to the ink composition. As used herein, "colorant" includes pigments and dyes, such as those that impart colors such as black, magenta, cyan, yellow and white to an ink. As used herein, "pigment" generally includes pigment colorants, magnetic particles, aluminas, silicas, and/or other ceramics or organo-metallics. Thus, though the present description primarily exemplifies the use of pigment colorants, the term "pigment" can be used more generally to describe not only pigment colorants, but other pigments such as organometallics, ferrites, ceramics, etc.

The thermoplastic resin may constitute at least 85 wt % of the solids of the transparent electrostatic ink composition, in some examples at least 90 wt % solids of the solids of the transparent electrostatic ink composition, in some examples 95, wt % of the solids of the transparent electrostatic ink composition.

If a solid polar compound is present, the thermoplastic resin and the solid polar compound together may constitute at least 85 wt % of the solids of the transparent electrostatic ink composition, in some examples at least 90 wt % of the solids of the transparent electrostatic ink composition, in some examples 95, wt % of the solids of the transparent electrostatic ink composition.

The transparent electrostatic ink composition may further comprise at least one additive such as surfactants, viscosity modifiers, emulsifiers and the like.

In some examples, once printed, the transparent electrostatic ink composition may forms a layer of less than 10 μm in thickness, for example less than 9 μm in thickness, less than 8 μm in thickness, less than 7 μm in thickness, less than 6 μm in thickness, less than 5 μm in thickness, less than 4 μm in thickness, less than 3 μm in thickness, less than 2 μm in thickness, less than 1.5 μm in thickness. In some examples, the transparent electrostatic ink composition is about 1 μm in thickness.

In some examples, once printed, the transparent electrostatic ink composition forms a layer greater than 0.1 μm in thickness, for example greater than 0.2 μm in thickness, greater than 0.3 μm in thickness, greater than 0.4 μm in thickness, greater than 0.5 μm in thickness, greater than 0.6 μm in thickness, greater than 0.7 μm in thickness, greater than 0.8 μm in thickness, greater than 0.9 μm in thickness.

Fourth Layer

The fourth layer is a coloured layer. In some examples, the fourth layer acts to obscure the information on the first layer, but can be scratched off, typically with the third layer, to reveal the underlying information on the first layer. The fourth layer may be a printed layer, and may be printed by any suitable print method, including, but not limited to electrostatic printing, ink-jet printing and offset lithography. The fourth layer may comprise a colourant selected from cyan, magenta, yellow, black and white.

In some examples, the fourth layer comprises a coloured electrostatic ink, printed in an electrostatic printing process, which may be a dry or a liquid electrostatic printing process. The coloured electrostatic ink may comprise a colourant selected from cyan, magenta, yellow, black and white. The coloured electrostatic ink may comprise at least 5 wt % solids of colorant, in some examples at least 8 wt % solids of colourant, in some examples at least 10 wt % solids of colourant, in some examples at least 10 wt % solids of colourant. The coloured electrostatic ink, which may also be termed a coloured electrostatic ink composition, may comprises a thermoplastic resin, which may be the same as or different from any thermoplastic resin that the transparent electrostatic ink contains.

The coloured electrostatic ink may substantially lack (e.g. contain less than 1 wt % solids) or lack a solid polar compound as described herein.

Various possible components of the transparent electrostatic ink of the third layer, and, if present, the coloured electrostatic ink of the fourth layer will now be described.

In some examples, some of the coloured material of the fourth layer may be printed directly onto the second layer. In some examples, the coloured material of the fourth layer extends beyond the third layer, such that it directly contacts the second layer.

Liquid Carrier

In some examples, when printing, the transparent electrostatic ink composition and/or the coloured electrostatic ink composition comprises a liquid carrier. The liquid carrier for the transparent electrostatic ink composition and the liquid carrier for the coloured electrostatic ink composition may be the same as one another or different from one another. Generally, the liquid carrier can act as a dispersing medium for the other components in the electrostatic ink composition. For example, the liquid carrier can comprise or be a hydrocarbon, silicone oil, vegetable oil, etc. The liquid carrier can include, but is not limited to, an insulating, non-polar, non-aqueous liquid that can be used as a medium for toner particles. The liquid carrier can include compounds that have a resistivity in excess of about $10^9$ ohm-cm. The liquid carrier may have a dielectric constant below about 5, in some examples below about 3. The liquid carrier can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the liquid carriers include, but are not limited to, aliphatic hydrocarbons, isoparaffinic compounds, paraffinic compounds, dearomatized hydrocarbon compounds, and the like. In particular, the liquid carriers can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before electrostatic printing, the liquid carrier can constitute about 20% to 99.5% by weight of the transparent and/or coloured electrostatic ink composition, in some examples 50% to 99.5% by weight of the transparent and/or coloured electrostatic ink composition. Before printing, the liquid carrier may constitute about 40 to 90% by weight of the transparent and/or coloured electrostatic ink composition. Before printing, the liquid carrier may constitute about 60% to 80% by weight of the transparent and/or coloured electrostatic ink composition. Before printing, the liquid carrier may constitute about 90% to 99.5% by weight of the transparent and/or coloured electrostatic ink composition, in some examples 95% to 99% by weight of the transparent and/or coloured electrostatic ink composition.

The transparent and/or coloured electrostatic ink, when electrostatically printed, may be substantially free from liquid carrier. In an electrostatic printing process and/or afterwards, the liquid carrier may be removed, e.g. by an electrophoresis processes during printing and/or evaporation, such that substantially just solids are transferred to print substrate (in the present context, when printed on the second or third layer, as appropriate). Substantially free from liquid carrier may indicate that the ink printed on the print substrate contains less than 5 wt % liquid carrier, in some examples, less than 2 wt % liquid carrier, in some examples less than 1 wt % liquid carrier, in some examples less than 0.5 wt % liquid carrier. In some examples, the ink printed on the print substrate is free from liquid carrier.

Thermoplastic Resin

The transparent and/or coloured electrostatic ink composition may include a thermoplastic resin, referred to as the resin. A thermoplastic polymer is sometimes referred to as a thermoplastic resin. The resin for the transparent electrostatic ink composition and the resin for the coloured electrostatic ink composition may be the same as one another or different from one another.

The resin typically includes a polymer. The resin can include, but is not limited to, a thermoplastic polymer. In some examples, the polymer of the resin may be selected from ethylene acrylic acid copolymers; ethylene methacrylic acid copolymers; ethylene vinyl acetate copolymers; copolymers of ethylene (e.g. 80 wt % to 99.9 wt %), and alkyl (e.g. C1 to C5) ester of methacrylic or acrylic acid (e.g. 0.1 wt % to 20 wt %); copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl is, in some examples, from 1 to about 20 carbon atoms, such as methyl methacrylate (e.g. 50 wt % to 90 wt %)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may comprise a polymer having acidic side groups. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may comprise a polymer, in some examples a polymer having acidic side groups, that has a melt flow rate of less than about 60 g/10 minutes, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of in some examples about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with at least one counterion, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as copolymers of ethylene and an ethylenically unsaturated acid of either acrylic acid or methacrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The polymer comprising acidic side groups can be a copolymer of ethylene and an ethylenically unsaturated acid of either acrylic or methacrylic acid, where the ethylenically unsaturated acid of either acrylic or methacrylic acid constitute from 5 wt % to about 25 wt % of the copolymer, in some examples from 10 wt % to about 20 wt % of the copolymer.

The resin may comprise two different polymers having acidic side groups. The two polymers having acidic side groups may have different acidities, which may fall within the ranges mentioned above. The resin may comprise a first polymer having acidic side groups that has an acidity of from 50 mg KOH/g to 110 mg KOH/g and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The resin may comprise two different polymers having acidic side groups: a first polymer that is a copolymer of ethylene (e.g. 92 to 85 wt %, in some examples about 89 wt %) and acrylic or methacrylic acid (e.g. 8 to 15 wt %, in some examples about 11 wt %) having a melt flow rate of 80 to 110 g/10 minutes and a second polymer that is a copolymer of ethylene (e.g. about 80 to 92 wt %, in some examples about 85 wt %) and acrylic acid (e.g. about 18 to 12 wt %, in some examples about 15 wt %), having a melt viscosity lower than that of the first polymer, the second polymer for example having a melt viscosity of 15000 poise or less, in some examples a melt viscosity of 10000 poise or less, in some examples 1000 poise or less, in some examples 100 poise or less, in some examples 50 poise or less, in some examples 10 poise or less. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

In any of the resins mentioned above, the ratio of the first polymer having acidic side groups to the second polymer having acidic side groups can be from about 10:1 to about 2:1. In another example, the ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin comprises a single type of resin polymer, the resin polymer (excluding any other components of the electrostatic ink composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic ink composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may comprise two different polymers having acidic side groups that are selected from copolymers of ethylene and an ethylenically unsaturated acid of either methacrylic acid or acrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The resin may comprise (i) a first polymer that is a copolymer of ethylene and an ethylenically unsaturated acid of either acrylic acid and methacrylic acid, wherein the ethylenically unsaturated acid of either acrylic or methacrylic acid constitutes from 8 wt % to about 16 wt % of the copolymer, in some examples 10 wt % to 16 wt % of the copolymer; and (ii) a second polymer that is a copolymer of ethylene and an ethylenically unsaturated acid of either acrylic acid and methacrylic acid, wherein the ethylenically unsaturated acid of either acrylic or methacrylic acid constitutes from 12 wt % to about 30 wt % of the copolymer, in some examples from 14 wt % to about 20 wt % of the copolymer, in some examples from 16 wt % to about 20 wt % of the copolymer in some examples from 17 wt % to 19 wt % of the copolymer.

In an example, the thermoplastic resin constitutes about 10 to 99%, in some examples about 15 to 95%, by weight of the solids of the transparent and/or coloured electrostatic ink composition. In another example, the resin constitutes about 20 to 95% by weight of the solids of the transparent and/or coloured electrostatic ink composition. In another example, the resin constitutes about 25 to 95% by weight of the solids of the transparent and/or coloured electrostatic ink composition. In another example, the resin constitutes about 35 to 95% by weight, in some examples from 75 to 95% by weight, of the solids of the transparent and/or coloured electrostatic ink composition. In another example, the resin constitutes about 35 to 95% by weight, in some examples from 75 to 99% by weight, of the solids of the transparent and/or coloured electrostatic ink composition.

The thermoplastic resin may comprise a polymer having acidic side groups, as described above (which may be free of ester side groups), and a polymer having ester side groups. The polymer having ester side groups is, in some examples, a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1 to 50% by weight of the co-polymer, in some examples 5 to 40% by weight, in some examples 5 to 20% by weight of the copolymer, in some examples 5 to 15% by weight of the copolymer. The second monomer may constitute 1 to 50% by weight of the co-polymer, in some examples 5 to 40% by weight of the co-polymer, in some examples 5 to 20% by weight of the co-polymer, in some examples 5 to 15% by weight of the copolymer. In an example, the first monomer constitutes 5 to 40% by weight of the co-polymer, the second monomer constitutes 5 to 40% by weight of the co-polymer, and with the third monomer constituting the remaining weight of the copolymer. In an example, the first monomer constitutes 5 to 15% by weight of the co-polymer, the second monomer constitutes 5 to 15% by weight of the co-polymer, with the third monomer constituting the remaining weight of the copolymer. In an example, the first monomer constitutes 8 to 12% by weight of the co-polymer, the second monomer constitutes 8 to 12% by weight of the co-polymer, with the third monomer constituting the remaining weight of the copolymer. In an example, the first monomer constitutes about 10% by weight of the co-polymer, the second monomer constitutes about 10% by weight of the co-polymer, and with the third monomer constituting the remaining weight of the copolymer. The polymer having ester side groups may be selected from the Bynel® class of monomer, including Bynel 2022 and Bynel 2002, which are available from DuPont®.

The polymer having ester side groups may constitute 1% or more by weight of the total amount of the resin polymers in the resin, e.g. the total amount of the polymer or polymers having acidic side groups and polymer having ester side groups. The polymer having ester side groups may constitute 5% or more by weight of the total amount of the resin polymers in the resin, in some examples 8% or more by weight of the total amount of the resin polymers in the resin, in some examples 10% or more by weight of the total amount of the resin polymers in the resin, in some examples 15% or more by weight of the total amount of the resin polymers in the resin, in some examples 20% or more by weight of the total amount of the resin polymers in the resin, in some examples 25% or more by weight of the total amount of the resin polymers in the resin, in some examples 30% or more by weight of the total amount of the resin polymers in the resin, in some examples 35% or more by weight of the total amount of the resin polymers in the resin. The polymer having ester side groups may constitute from 5% to 50% by weight of the total amount of the resin polymers in the resin, in some examples 10% to 40% by weight of the total amount of the resin polymers in the resin, in some examples 15% to 30% by weight of the total amount of the polymers in the resin.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

In an example, the polymer or polymers of the resin can be selected from the Nucrel family of toners (e.g. Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynell 2002, Bynell 2014, and Bynell 2020 (sold by E. I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)).

Charge Director and Charge Adjuvant

In some examples, the transparent and/or coloured electrostatic ink composition includes either a charge director or a charge adjuvant or both.

The charge director may be added in order to impart and/or maintain sufficient electrostatic charge on ink particles during electrostatic printing, which may be particles comprising the thermoplastic resin (and, for the transparent electrostatic ink, the solid polar compound, if present, as mentioned herein). The charge director may comprise ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of sulfonic acid. The sulfonic acids may include, but are not limited to, alkyl sulfonic acids, aryl sulfonic acids, and sulfonic acids of alkyl succinates. The charge director can impart a negative charge or a positive charge on the resin-containing particles of an electrostatic ink composition.

In some examples, the transparent and/or coloured electrostatic ink composition comprises a charge director comprising a simple salt. Simple salts are salts that do not form micelles by themselves, although they may form a core for micelles with a micelle forming salt. The ions constructing the simple salts are all hydrophilic. The simple salt may include a cation selected from the group consisting of Mg, Ca, Ba, NH4, tert-butyl ammonium, Li+, and Al+3, or from any sub-group thereof. The simple salt may include an anion selected from the group consisting of $SO_4^{2-}$, $PO^{3-}$, $NO^{3-}$, $HPO_4^{2-}$, $CO_3^{2-}$, acetate, trifluoroacetate (TFA), $Cl^-$, $BF_4^-$, F—, $ClO_4$—, and $TiO_3^{4-}$, or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof.

The charge director may include at least one of (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In some examples, the transparent and/or coloured electrostatic ink composition comprises a charge director comprising a sulfosuccinate salt of the general formula MAn, wherein M is a metal, n is the valence of M, and A is an ion of the general formula (I):

$$[R^1—O—C(O)CH_2CH(SO_3)C(O)—O—R^2]^- \quad (I)$$

wherein each of $R^1$ and $R^2$ is an alkyl group.

The sulfosuccinate salt of the general formula MAn is an example of a micelle forming salt. The charge director may be substantially free or free of an acid of the general formula HA, where A is as described above. The charge director may include micelles of said sulfosuccinate salt enclosing at least some of the nanoparticles. The charge director may include at least some nanoparticles having a size of 200 nm or less, and/or in some examples 2 nm or more.

In the formula $[R_1—O—C(O)CH_2CH(SO_3^-)C(O)—O—R_2]$, in some examples each of $R_1$ and $R_2$ is an aliphatic alkyl group. In some examples, each of $R_1$ and $R_2$ independently is a C6-25 alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$. In some examples, M is Na, K, Cs, Ca, or Ba.

In some examples, the charge director constitutes about 0.001% to 20%, in some examples 0.01% to 20% by weight, in some examples 0.01 to 10% by weight, in some examples 0.01% to 1% by weight of the solids of the transparent and/or coloured electrostatic ink composition. In some examples, the charge director constitutes about 0.001% to 0.15% by weight of the solids of the transparent and/or coloured electrostatic ink composition, in some examples 0.001% to 0.15%, in some examples 0.001% to 0.02% by weight of the solids of the transparent and/or coloured electrostatic ink composition, in some examples 0.1% to 2% by weight of the solids of the transparent and/or coloured electrostatic ink composition, in some examples 0.2% to 1.5% by weight of the solids of the transparent and/or coloured electrostatic ink composition in some examples 0.1% to 1% by weight of the solids of the transparent and/or coloured electrostatic ink composition, in some examples 0.2% to 0.8% by weight of the solids of the transparent and/or coloured electrostatic ink composition. In some examples, the charge director is present in an amount of at least 1 mg of charge director per gram of solids of the transparent and/or coloured electrostatic ink composition (which will be abbreviated to mg/g), in some examples at least 2 mg/g, in some examples at least 3 mg/g, in some examples at least 4 mg/g, in some examples at least 5 mg/g. In some examples, the charge director is present in the amounts stated above, and the charge director is present in an amount of from 1 mg to 50 mg of charge director per gram of solids of the transparent and/or coloured electrostatic ink composition (which will be abbreviated to mg/g), in some examples from 1 mg/g to 25 mg/g, in some examples from 1 mg/g to 20 mg/g, in some examples from 1 mg/g to 15 mg/g, in some examples from 1 mg/g to 10 mg/g, in some examples from 3 mg/g to 20 mg/g, in some examples from 3 mg/g to 15 mg/g, in some examples from 5 mg/g to 10 mg/g.

A charge adjuvant may promote charging of the particles when a charge director is present in the transparent and/or coloured electrostatic ink composition during printing. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an example, the charge adjuvant is or includes aluminum di- or tristearate. The charge adjuvant may be present in an amount of about 0.1 to 5% by weight, in some examples about 0.1 to 1% by weight, in some examples about 0.3 to 0.8% by weight of the solids of the transparent and/or coloured electrostatic ink composition, in some examples about 1 wt % to 3 wt % of the solids of the transparent and/or coloured electrostatic ink composition, in some examples about 1.5 wt % to 2.5 wt % of the solids of the transparent and/or coloured electrostatic ink composition.

In some examples, the transparent and/or coloured electrostatic ink composition further includes, e.g. as a charge adjuvant, a salt of multivalent cation and a fatty acid anion. The salt of multivalent cation and a fatty acid anion can act as a charge adjuvant. The multivalent cation may, in some examples, be a divalent or a trivalent cation. In some examples, the multivalent cation is selected from Group 2, transition metals and Group 3 and Group 4 in the Periodic Table. In some examples, the multivalent cation includes a metal selected from Ca, Sc, Ti, V, Cr, Mn, Fe, Co, Ni, Cu, Zn, Al and Pb. In some examples, the multivalent cation is Al3+. The fatty acid anion may be selected from a saturated or unsaturated fatty acid anion. The fatty acid anion may be selected from a $C_8$ to $C_{26}$ fatty acid anion, in some examples a $C_{14}$ to $C_{22}$ fatty acid anion, in some examples a $C_{16}$ to $C_{20}$ fatty acid anion, in some examples a $C_{17}$, $C_{18}$ or $C_{19}$ fatty acid anion. In some examples, the fatty acid anion is selected from a caprylic acid anion, capric acid anion, lauric acid anion, myristic acid anion, palmitic acid anion, stearic acid anion, arachidic acid anion, behenic acid anion and cerotic acid anion.

The charge adjuvant, which may, for example, be or include a salt of multivalent cation and a fatty acid anion, may be present in an amount of 0.1 wt % to 5 wt % of the solids of the transparent and/or coloured electrostatic ink composition, in some examples in an amount of 0.1 wt % to 2 wt % of the solids of the transparent and/or coloured electrostatic ink composition, in some examples in an amount of 0.1 wt % to 2 wt % of the solids of the transparent and/or coloured electrostatic ink composition, in some examples in an amount of 0.3 wt % to 1.5 wt % of the solids of the transparent and/or coloured electrostatic ink composition, in some examples about 0.5 wt % to 1.2 wt % of the solids of the transparent and/or coloured electrostatic ink composition, in some examples about 0.8 wt % to 1 wt % of the solids of the transparent and/or coloured electrostatic ink composition, in some examples about 1 wt % to 3 wt % of the solids of the transparent and/or coloured electrostatic ink composition, in some examples about 1.5 wt % to 2.5 wt % of the solids of the transparent and/or coloured electrostatic ink composition.

Solid Polar Compound

The transparent electrostatic ink composition may comprise a solid polar compound. In some examples, the solid polar compound is a solid (e.g., at room temperature, i.e., from about 20° C. to about 25° C.), organic material. The solid polar compound may be of low tinctorial strength (e.g. lower in tinctorial strength than any pigment or dye used in the coloured electrostatic ink composition). Once printed in the transparent electrostatic ink composition, the solid polar compound typically imparts little, if any, colour to it. The solid organic material may be a polymeric material or a non-polymeric material. The solid polar compound may be an organic particle that is resistant to swelling or dissolving in a non-polar carrier fluid, e.g. an isoparaffinic fluid as described herein. The solid polar compound may be dispersed in the resin, and, in some examples, is present in an amount up to 60 wt. % of solids in the transparent electrostatic ink composition, in some examples from 10 wt % to 60 wt % of solids in the transparent electrostatic ink composition. The solid polar compound may be selected from the group consisting of a saccharide, polyacrylic acid, polyvinyl alcohol, styrene maleic anhydride, a bismaleimide oligomer, a cellulose derivative and an aliphatic urethane acrylate.

In some examples, the transparent electrostatic ink composition comprises a saccharide or a modified saccharide. In some examples, modified saccharides are acetylated saccharides. In some examples, the transparent electrostatic ink composition comprises a disaccharide or a modified disaccharide. In some examples, the transparent electrostatic ink composition comprises a saccharide or modified saccharide selected from maltose monohydrate, sucrose, sucrose octanoate, sucrose octaacetate, dextrin, xylitol and sucrose benzoate.

In some examples, the transparent electrostatic ink composition comprises the solid polar compound, e.g. a saccharide or a modified saccharide, in an amount greater than 15 wt % of the non-volatile solids in the electrostatic ink composition, for example, in an amount greater than 20 wt % of the non-volatile solids in the transparent electrostatic ink composition, for example in an amount greater than 25 wt % of the non-volatile solids in the transparent electrostatic ink composition, for example in an amount greater than 30 wt % of the non-volatile solids in the transparent electrostatic ink composition. In some examples, the transparent electrostatic ink composition comprises the solid polar compound, e.g. a saccharide or a modified saccharide, in an amount of less than 60 wt % of the non-volatile solids in the transparent electrostatic ink composition, for example less than 50 wt % of the non-volatile solids in the electrostatic ink composition, for example less than 45 wt % of the non-volatile solids in the transparent electrostatic ink composition, for example less than 40 wt % of the non-volatile solids in the transparent electrostatic ink composition.

In some examples, the saccharide is selected from the group consisting of maltose monohydrate, sucrose, sucrose octanoate, dextrin, xylitol, sucrose octaacetate, and sucrose benzoate. In some examples, the solid polar compound has a particle size from about 30 nm to about 300 nm.

Examples of commercially available styrene maleic anhydrides include copolymers from Sartomer Co. USA, LLC, such as SMA® 40001, SMA® 10001, and SMA® 1000P. Examples of cellulose derivatives include sodium carboxylmethyl cellulose and cellulose acetate propionate. A suitable example of a bismaleimide oligomer is bis-stearamide, and a suitable example of an aliphatic urethane acrylate is REAFREE® UV ND-2335 from Arkema, Spain. It is to be understood that these solid polar compounds are examples, and that any other organic material that includes polar atoms and is resistant to swelling or dissolving in a non-polar carrier fluid may be used.

Other Additives

The transparent and/or coloured electrostatic ink composition may include an additive or a plurality of additives. The additive or plurality of additives may be added at any stage of the method. The additive or plurality of additives may be selected from a wax, a surfactant, biocides, organic solvents, viscosity modifiers, materials for pH adjustment, sequestering agents, preservatives, compatibility additives, emulsifiers and the like. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the ink film to the print substrate, e.g. from an intermediate transfer member, which may be a heated blanket.

Scratch-Off Structure

As mentioned, the present disclosure provides a scratch-off structure comprising the following layers in order:

- a substrate having a first layer showing information thereon,
- a second layer comprising a polymeric film and being substantially transparent;
- a third layer comprising a transparent electrostatic ink;
- a fourth layer, wherein the fourth layer is coloured.

The scratch-off structure may have been produced by the method described herein, and may comprise the components mentioned for each layer herein.

As indicated, FIG. 1 schematically depicts a cross-section of an example of a scratch-off structure before (a) and after (b) the third and fourth layers have been scratched off.

Figure 2:
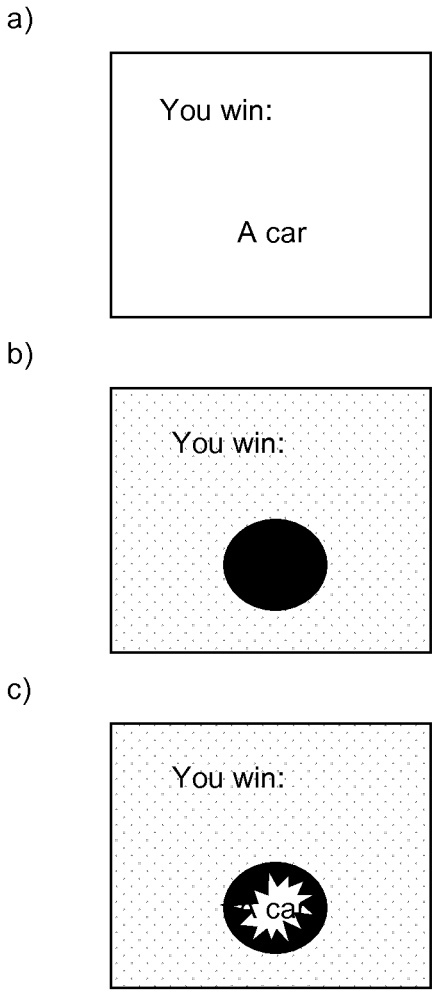
FIGS. 2(*a*) to (*c*) shows schematically an example of a scratch-off structure being produced and then having a portion scratched off to reveal information.

FIGS. 2(*a*) to (*c*) shows schematically an example of a scratch-off structure being produced and then having a portion scratched off to reveal information.

FIG. 1*a* shows a cross-sectional diagram of an example scratch-off structure (100). The scratch-off structure comprises a substrate (101*a*) having a first layer showing information (101*b*) thereon. A second layer comprising a polymeric film (102) and being substantially transparent is disposed on the substrate (101*a*) having a first layer showing information (101*b*) thereon. A transparent third layer (103) comprising a transparent electrostatic ink is disposed on the second layer (102) over at least the area covered by the information (101*b*) shown on the substrate (101*a*). A fourth, coloured, layer (104) is disposed on the third layer (103) and optionally on any areas of the second layer (102) not covered by the third layer (103). The fourth coloured layer obscures the information on the first layer.

FIG. 1*b* shows a cross-sectional diagram of the scratch-off structure (100) shown in FIG. 1*a* after the scratch-off portions (the third and fourth layers) have been scratched off. The adhesion of the third layer (103) to the second layer (102) is low enough that the third layer and any layers, such as the fourth layer (104), adhered to it can be removed by use of abrasion, such as scratching with a coin, finger nail, or other suitable object. The removal of the third (103) and fourth (104) layers allows the information (101*b*) shown on the substrate (101*a*) to become visible.

FIG. 2 shows schematically an example of a scratch-off structure, when viewing from above the layers. FIG. 2*a* depicts an example of the substrate having a first layer showing information (in this case the phrase "You win: A car"). FIG. 2*b* depicts a scratch-off structure in which a third layer comprising a transparent electrostatic ink has been printed in a circular portion over part of the information ("a car") shown on the substrate and over which has been printed an opaque circle, forming a part of the fourth, coloured, layer. The remaining part of the fourth layer has been printed directly onto the second layer comprising a polymeric film, providing the background pattern. In some examples, this background pattern may have formed part of the substrate showing information and consequently may be beneath the second layer. FIG. 2*c* depicts the scratch-off structure once the surface has been scratched and the third and fourth layers have been partially removed from the second layer, revealing the information ("A car"). Additional scratching would result in complete removal of the third layer and overlying fourth layer, removing the entire opaque circle.

EXAMPLES

The following illustrates examples of the method, scratch-off structures and related aspects described herein. Thus, these examples should not be considered to restrict the present disclosure, but are merely in place to teach how to make examples of the scratch-off structure of the present disclosure.

In the following Examples, a HP Indigo ElectroInk® digital primer is used as the transparent electrostatic ink. HP Indigo ElectroInk® Primer may be made as follows.

In the following examples, the resin used is Nucrel 699, available from DuPont, and A-C 5120, available from Honeywell, in a weight ratio of 4:1.

In the following examples, NCD indicates a natural charge director made of three components: KT (natural soya lecithin in phospholipids and fatty acids), BBP (basic barium petronate i.e. a barium sulfonate salt of a 21-26 hydrocarbon alkyl, supplied by Chemtura), and GT (dodecyl benzene sulfonic acid isopropyl amine, supplied by Croda). The composition being 6.6 wt % KT, 9.8 wt % BBP and 3.6 wt % GT, balance 80% Isopar.

In the following examples, SCD indicates a synthetic charge director, being a barium bis sulfosuccinate salt as described in US 2009/0311614 or WO2007130069. This is a strong negative charge director with strong base in the micelle core (barium phosphate) which enhances stable negative charge on ink particle. SCD is a charge director and in the absence of a dispersant) has been found to display very low low field charging (high charge partitioning).

The transparent electrostatic ink for forming the HP Indigo ElectroInk® Primer comprised 73.14 g paste (an isoparaffinic non-polar carrier fluid with ethylene methacrylic acid copolymers and ethylene acrylic acid co-polymers dispersed therein, namely Nucrel 699 (DuPont) and A-C 5120 (Honeywell) in the ratio of 4:1 (wt:wt)). The paste contained 35 wt % resin solids (i.e. the combination of Nucrel 699 (DuPont) and A-C 5120 (Honeywell)), 35 wt % maltosemonohydrate (Fisher) and 1.0 wt % aluminum stearate (grinding aid material/charge adjuvant, available from Sigma Aldrich). The ink was ground using an attritor (S0 from union process USA) at 25° C. for 24 hours. The ink was diluted to 2 wt % solids in Isopar, charged by adding 8 ml of commercially available HP Indigo Imaging Agent (for use with HP Indigo 6000 series presses; Imaging Agent contains NCD, but SCD could be used) and left over-night prior to printing.

Coloured HP Indigo ElectroInk® Ink is similar to HP Indigo ElectroInk® Primer, except that it does not contain the maltosemonohydrate, and instead contains a colourant, such as cyan, magenta, yellow, black or white pigments.

Example 1

Information, in the form of words, letters, images or any combination thereof, was printed onto a paper substrate (300 g Condat paper) by using an HP Indigo 7000 printing press to form a first layer showing information.

DigiGuard® Gloss 210 (from Michelman, Inc), a transparent varnish, diluted to 10% with water, was applied over the first layer by using drawdown rod #2 (designed to apply a 4.15 μm thick wet layer; from Diversified Enterprises, USA), forming a second layer.

HP Indigo ElectroInk® Digital Primer was then printed (by using an HP Indigo 7000 printing press) over the combined first and second layers to form a third layer on top of the second layer, such that the third layer covered at least the portion of the first layer showing information.

Finally, a fourth layer, comprising a coloured liquid electrostatic ink (e.g. magenta, cyan, yellow, black or white, or a mixture thereof), in this case HP Indigo ElectroInk®, was applied over the third layer, providing an opaque layer through which the information printed on the paper substrate cannot be perceived. In some cases, the fourth layer extended over a larger area of the paper substrate than the third layer.

The concealed information was revealed by scratching, removing both the third and fourth layers of ink. Although the HP Indigo ElectroInk® digital primer acts as a primer when printed on paper, when printed directly onto a polymeric substrate (such as the DigiGuard® Gloss used here) the interaction of the primer with the polymeric layer is significantly weaker than the interaction of a coloured LEP ink with a polymeric layer. Consequently, the transparent LEP ink acts as a release layer, allowing the information on the substrate to be revealed.

Any coloured LEP ink (fourth layer) printed over a portion of the substrate not covered by the HP Indigo ElectroInk® Digital Primer (third layer), that is, printed directly on the second layer, was not as easily removed by scratching, remaining in place after the third layer had been removed.

Example 2

Information, in this case in the form of numbers, was printed on a paper substrate (300 g Condat paper) by using an HP Indigo 7000 printing press, providing a first layer showing information.

A Polynex Thermal (25 μm thick) film (from LMP) was laminated onto the first layer by using a laboratory laminator (GMP EXCELAM PLUS 355RM) at 120° C. and 1.9 m/min, forming the second layer. The thermal film was a bi-axially orientated polypropylene (BOPP) film, having a layer of ethylene vinyl acetate (EVA) as a thermal adhesive thereon.

HP Indigo ElectroInk® Digital Primer was then printed onto the second layer, over an area slightly larger than the area of the substrate showing information.

A visible image was then printed on the primed substrate by using an HP Indigo 7000 printing press. The visible image provided an opaque layer over at least the portion of the substrate showing information.

The information concealed under the visible image was revealed by scratching the surface of the scratch-off structure with a coin. While the LEP ink printed over the HP Indigo ElectroInk® Digital Primer was relatively easily removed from the polymeric substrate, neither the LEP ink printed over areas of the substrate not covered by the Digital Primer nor any information below the Polynex Thermal film was removed.

While the method and scratch-off structure has been described with reference to certain examples, those skilled in the art will appreciate that various modifications, changes, omissions, and substitutions can be made without departing from the spirit of the disclosure. It is intended, therefore, that the disclosure be limited by the scope of the following claims. The feature(s) of any dependent claim can be combined with the feature(s) of any of the other dependent claims and any of the independent claims.

The invention claimed is:

1. A scratch-off structure comprising the following layers in order:

a substrate having a first layer showing information thereon, a second layer comprising a polymeric film and being substantially transparent;

a third layer comprising a transparent electrostatic ink, wherein the transparent electrostatic ink comprises a solid polar compound selected from the group consisting of a saccharide, polyacrylic acid, polyvinyl alcohol, styrene maleic anhydride, a bismaleimide oligomer, a cellulose derivative and an aliphatic urethane acrylate;

a fourth layer, wherein the fourth layer is coloured, wherein adhesion between the third layer and the second layer is sufficiently weak that the third layer and fourth layer are removable by scratching.

2. The scratch-off structure according to claim 1, wherein the fourth layer comprises a coloured electrostatic ink.

3. The scratch-off structure according to claim 2, wherein the transparent electrostatic ink and/or the coloured electrostatic ink comprises a resin comprising a co-polymer of ethylene and methacrylic acid and/or a co-polymer of ethylene and acrylic acid.

4. The scratch-off structure according to claim 2, wherein the transparent electrostatic ink and/or the coloured electrostatic ink comprises a charge director and/or a charge adjuvant.

5. The scratch-off structure according to claim 1, wherein the solid polar compound is a saccharide and wherein the saccharide is a disaccharide.

6. The scratch-off structure according to claim 1, wherein the solid polar compound is a saccharide and wherein the saccharide is selected from maltose monohydrate, sucrose, sucrose octanoate, sucrose octaacetate, dextrin, xylitol and sucrose benzoate.

7. The scratch-off structure according to claim 1, wherein the solid polar compound is present in an amount of from 10 wt % to 60 wt % of the solids of the transparent electrostatic ink.

8. The scratch-off structure according to claim 6, wherein the transparent electrostatic ink comprises a resin comprising a co-polymer of ethylene and methacrylic acid and/or a co-polymer of ethylene and acrylic acid.

9. The scratch-off structure according to claim 1, wherein the third layer is selectively printed over a portion of the second layer and wherein the second layer includes areas not covered by the third layer.

10. A method for producing the scratch-off structure of claim 1, the method comprising:

providing the substrate having the first layer showing information thereon and the second layer overlying the first layer;

electrostatically printing the third layer over the second layer; and disposing the fourth layer on the third layer.

11. The method according to claim 10, wherein the fourth layer is disposed by electrostatically printing a coloured electrostatic ink onto the third layer.

12. The method according to claim 10, wherein the solid polar compound is a saccharide and the saccharide is a disaccharide.

13. The method according to claim 12, wherein the saccharide is selected from maltose monohydrate, sucrose, sucrose octanoate, sucrose octaacetate, dextrin, xylitol and sucrose benzoate.

14. The method according to claim 10, wherein the solid polar compound is present in an amount of from 10 wt % to 60 wt % of the solids of the transparent electrostatic ink.

15. The method according to claim 10, wherein the transparent electrostatic ink comprises a resin comprising a co-polymer of ethylene and methacrylic acid and/or a co-polymer of ethylene and acrylic acid.

16. The method according to claim 10, wherein the polymeric film is an overprint varnish or a film of clear plastic material adhered to the first layer of the substrate.

17. A collection of scratch-off structures, wherein at least some of the scratch-off structures comprise the scratch-off structure of claim 1.

* * * * *